United States Patent [19]

Betush

[11] Patent Number: 4,610,630

[45] Date of Patent: Sep. 9, 1986

[54] DENTAL INSTRUMENT STAND

[75] Inventor: Frank A. Betush, Carson, Calif.

[73] Assignee: Progressive Machine Products, Inc., Carson, Calif.

[21] Appl. No.: 755,841

[22] Filed: Jul. 17, 1985

[51] Int. Cl.[4] ..... A61G 1/14

[52] U.S. Cl. ..... 433/79

[58] Field of Search ..... 433/77, 78, 79, 33, 433/107, 108, 109

[56] References Cited

U.S. PATENT DOCUMENTS 3,160,379 12/1964 Gardella ..... 433/79

3,650,033 3/1972 Behne et al. ..... 433/79

*Primary Examiner*—Robert Peshock

*Attorney, Agent, or Firm*—Keith D. Beecher

[57] ABSTRACT

A counter-balanced parallel arm assembly for supporting a control unit for dental handpieces, such as high speed air drills, and other air driven or electrically energized dental instruments which are removably mounted on the control unit, or for supporting other medical, electrical, electronic, or other units. The assembly includes an upright standard, a first arm mounted on the standard to be rotatable about a vertical axis, and a second arm coupled to the end of the first arm and rotatable about both vertical and horizontal axes. The supported unit is suspended from the end of the second arm by a post, and it is rotatable about the longitudinal axis of the post. The post is pivotally coupled to the end of the second arm to be rotatable about a horizontal axis. The supported unit may be set to any desired vertical and horizontal position to locate it for convenient access by the operator. The inclination of the second arm to the first arm is controlled by a counter-balancing coil spring and cam assembly, and the second arm is set to a desired inclination by an air-operated lock. A leveling assembly is mounted at the end of the second arm for setting the supported unit in a horizontal plane for different inclinations of the second arm.

8 Claims, 8 Drawing Figures

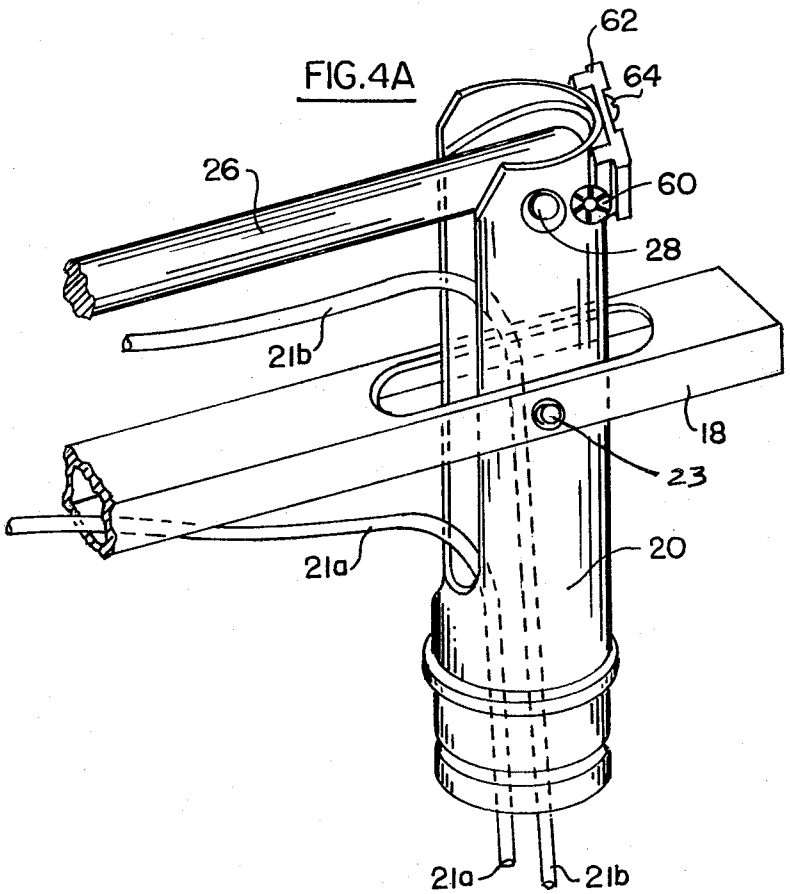
FIG. 4A
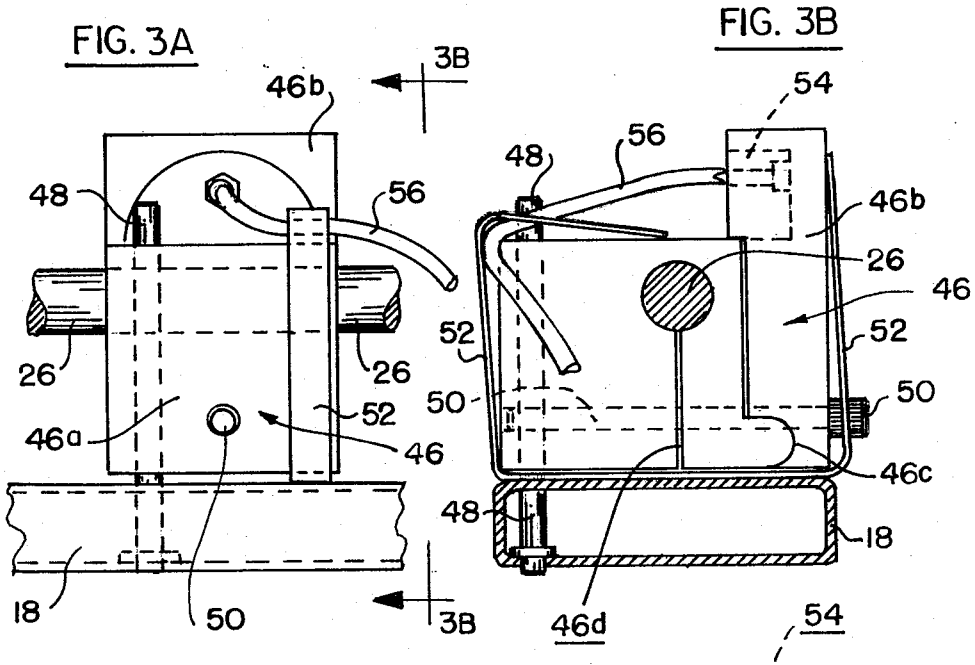
FIG. 3B
FIG. 3A
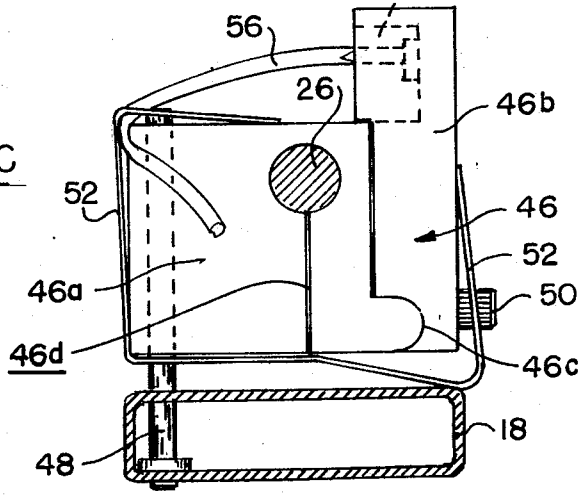
FIG. 3C

DENTAL INSTRUMENT STAND

BACKGROUND OF THE INVENTION

The assembly of the present invention has particular although not exclusive utility in supporting a dental control unit on which dental instruments, such as handpieces, syringes, and the like, as well as the usual controls for the instruments, are removably mounted, and the assembly enables the control unit to be conveniently positioned over the dental chair so that the instruments are readily accessible to the dentist in his direct working area; the control unit being movable vertically and horizontally by the dentist to a desired position. As mentioned above, the assembly of the invention may also be used for supporting other units in adjustable vertical and horizontal positions.

Accordingly, an important objective of the invention is to provide an improved spring counter-balanced arm assembly which is rugged in its construction, and which permits the supported unit to be set at any desired vertical level. The setting of the supported unit at any desired vertical level is achieved by the assembly, and the supported unit may be locked at any desired vertical level by an air operated lock. In addition, means is provided for leveling the supported unit in a horizontal plane after it has been set to the desired vertical level.

BRIEF DESCRIPTION OF THE DRAWINGS

FIG. 3A is a side elevational view of an air operated lock which is included in the assembly of FIG. 1;

FIG. 3B is an end view of the lock of FIG. 3A taken essentially along the lines 3B—3B of FIG. 3A;

FIG. 3C is an end view of the lock, like FIG. 3B, but taken from the opposite end;

FIG. 4A is a fragmentary perspective view of a portion of the assembly of FIG. 1, showing details of a leveling mechanism which is included in the assembly;

DETAILED DESCRIPTION OF THE ILLUSTRATED EMBODIMENT

Figure 1:
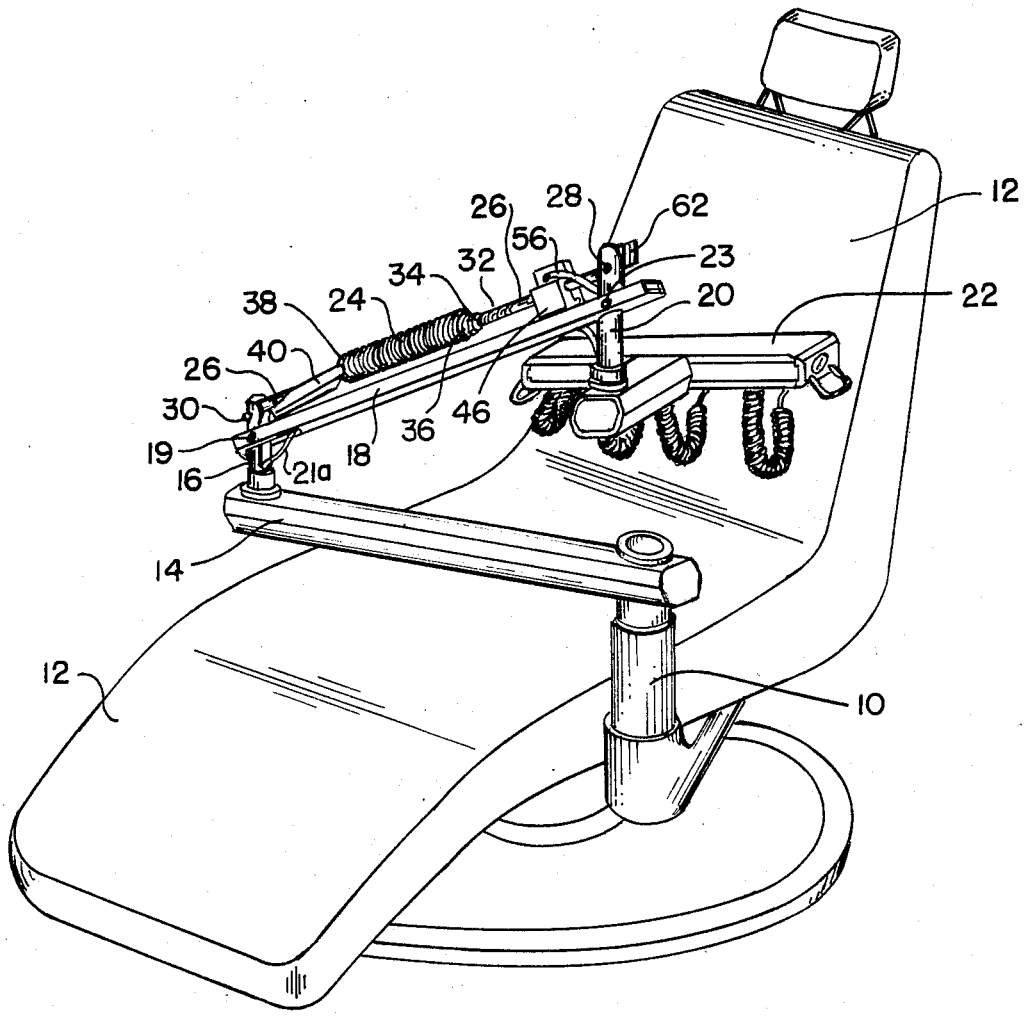
FIG. 1 is a perspective representation of one embodiment of the assembly of the present invention in conjunction with dentistry and mounted on a dental chair.

In the assembly of FIG. 1, a hollow upright standard 10 is mounted on a dental chair 12, and a hollow horizontal arm 14 is rotatably mounted on standard 10. A hollow vertical post 16 is rotatably mounted on the end of arm 14. An arm 18 is pivotally mounted on post 16 to be angularly movable about a horizontal axis. A further arm 20 is pivotally mounted on the end of arm 18 by a pivot pin 23 to be angularly movable about a horizontal axis.

A control unit 22 is mounted on the lower end of arm 20 to be rotatable about the longitudinal axis of the arm. The control unit may be similar to the control unit described and claimed in U.S. Pat. No. 3,986,262 which is assigned to the present assignee. The control unit supports a number of dental handpieces which may be of the high-pressure air-driven or electrical type, such as described in the patent. Supply leads and lines, such as the lines 21*a* and 21*b* (FIGS. 1 and 4A) for the handpieces may be carried internally by the members 10, 14, 16, 18 and 20.

Figure 2:
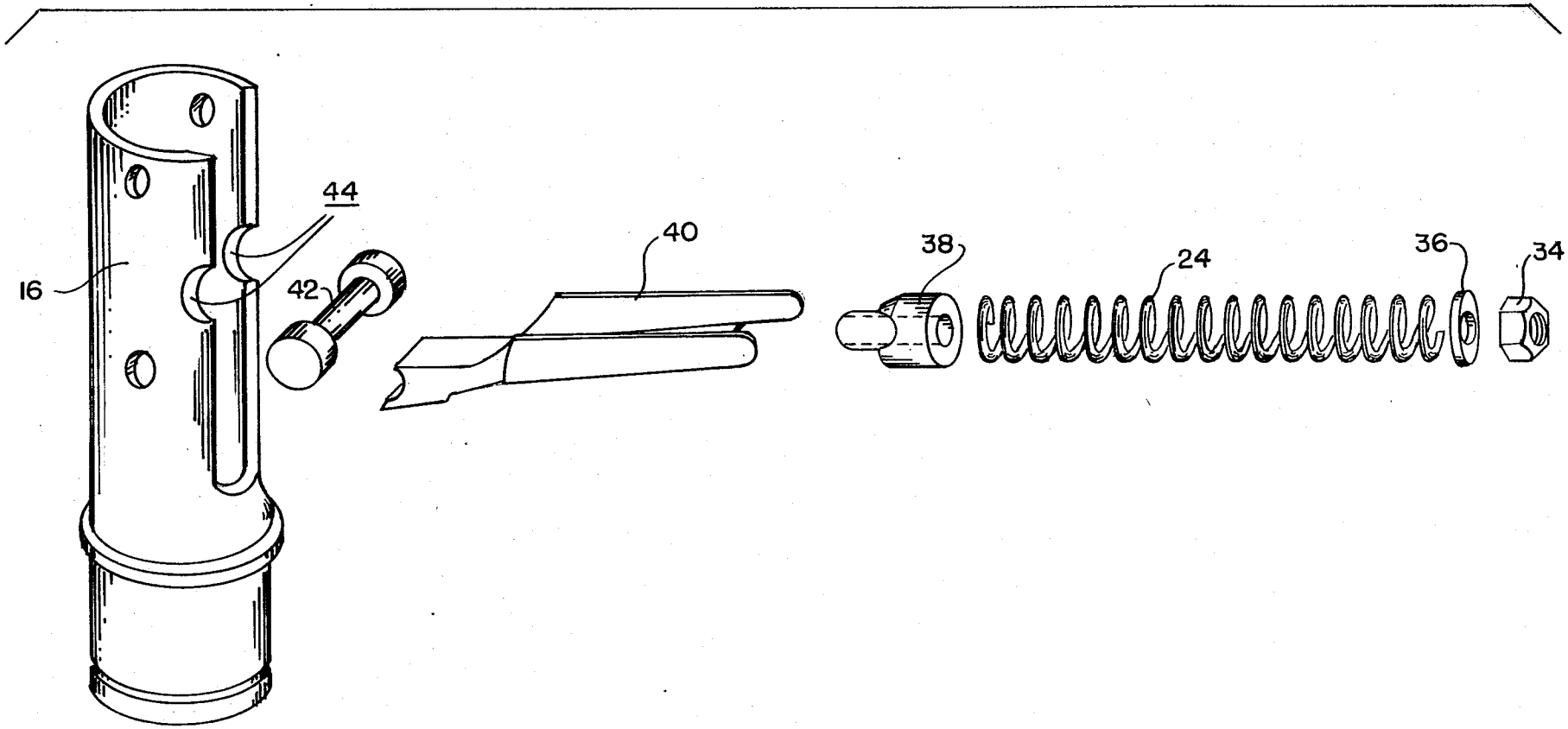
FIG. 2 is an exploded perspective view of certain components of the assembly of FIG. 1.

A spring 24 is provided which counter balances the weight of control unit 22, and which enables the arm 18 to be moved easily about the pivot pin 19 which couples the arm to post 16. A rod 26 extends coaxially through the spring in essentially spaced and parallel relationship with arm 18. Post 16 is, likewise, essentially parallel to post 20. One end of rod 26 is pivotally attached to the upper end of arm 20 by a pivot pin 28, and the other end of the rod is pivotally attached to the upper end of post 16 by a pivot pin 30. An intermediate portion of rod 26 is threaded, as designated 32. A nut 34 is threaded to the intermediate portion of rod 26 and, together with a washer 36, serves as a stop for spring 24. A bushing 38 (FIG. 2) engages the other end of spring 24, and the bushing is slidable on rod 26. A bifurcated member 40 engages the sides of bushing 38. Rod 26 extends through member 40, a shown in FIG. 1, to the pivot pin 30.

A cam follower 42 is rotatably received in the left-hand end of bifurcated member 40 (FIG. 2) and the ends of cam follower 42 are rotatably received in arcuate cam grooves 44 is post 16. The cam grooves 44 and cam follower 42 cause the proper compressive forces to be exerted on spring 24 as the arm 38 is turned up and down, so that the spring 24 performs its desired counter-balancing effect, as the dentist adjusts controller 22 to a desired vertical position.

The controller may then be locked in the desired vertical position by an air operated lock 46, which is shown in FIGS. 3A, 3B and 3C. As shown in FIGS. 3A, 3B and 3C, rod 26 extends through lock 46. When the lock is released, spring 52 returns block 46*b* to its original position, and rod 26 slides freely through the lock.

The lock includes a first metal block 46*a* which is attached to arm 18 by means of a pin 48, which permits the block to articulate vertically on pin 48 during unlocked movement of the control. Rod 26 extends through a hole in block 46*a*. Block 46*a* has a slot 46*d* extending radially outwardly from the hole to the bottom of the block.

Lock 46 includes a second block 46*b* which is pivotally mounted on one side of block 46*a* by mating arcuate surfaces 46*c*. The two blocks are held in an assembled state by a screw 50, and by an encompassing resilient strip spring member 52, which holds the blocks biased in their unlocked position.

Block 46*b* has an internal cylinder 54 which contains a piston, or a swelling tube, and when pressurized air is introduced into the chamber through a tube 56, block 46*b* is cuased to rock about arcuate surfaces 46*c*, squeezing the sides of slot 46*d* together to prevent the rod 26 from sliding through the hole in block 46*a*.

Accordingly, arm 18 may be locked at any desired inclination, merely by introducing pressurized air to the lock under the control of the dentist. Variable amounts of resistance to movement may be provided by adjusting screw 50 to provide "drag" between block 46 and rod 26 when no air pressure is present.

Control unit 22 may be leveled at any inclination of arm 18 by adjusting a bolt-like member 60. Member 60 extends through a groove at one side of post 20 by a bracket 62 which is mounted to the post by a screw 64.

Figure 4C:
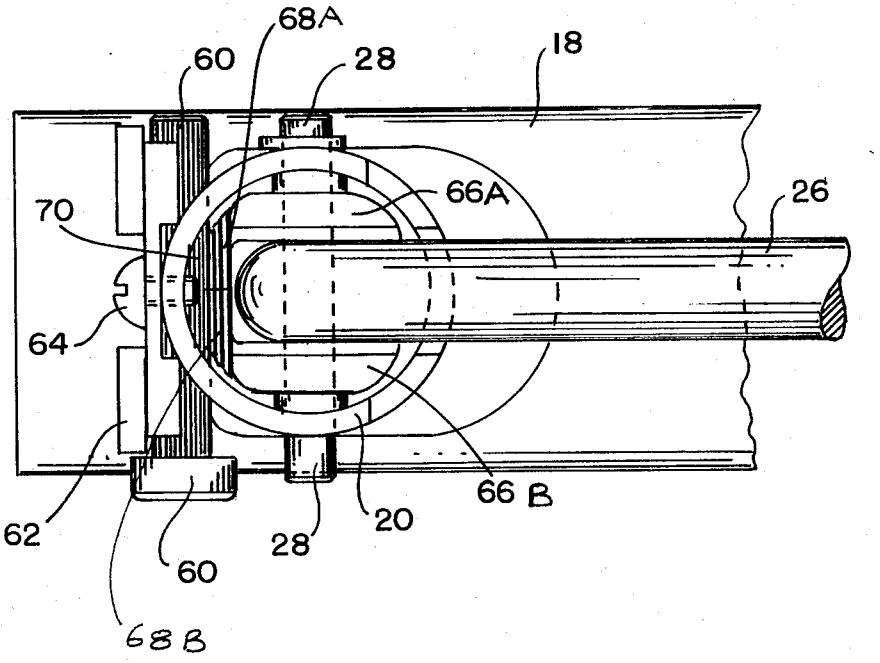
FIG. 4C is a top view of the portion of the assembly shown in FIG. 4B.
Figure 4B:
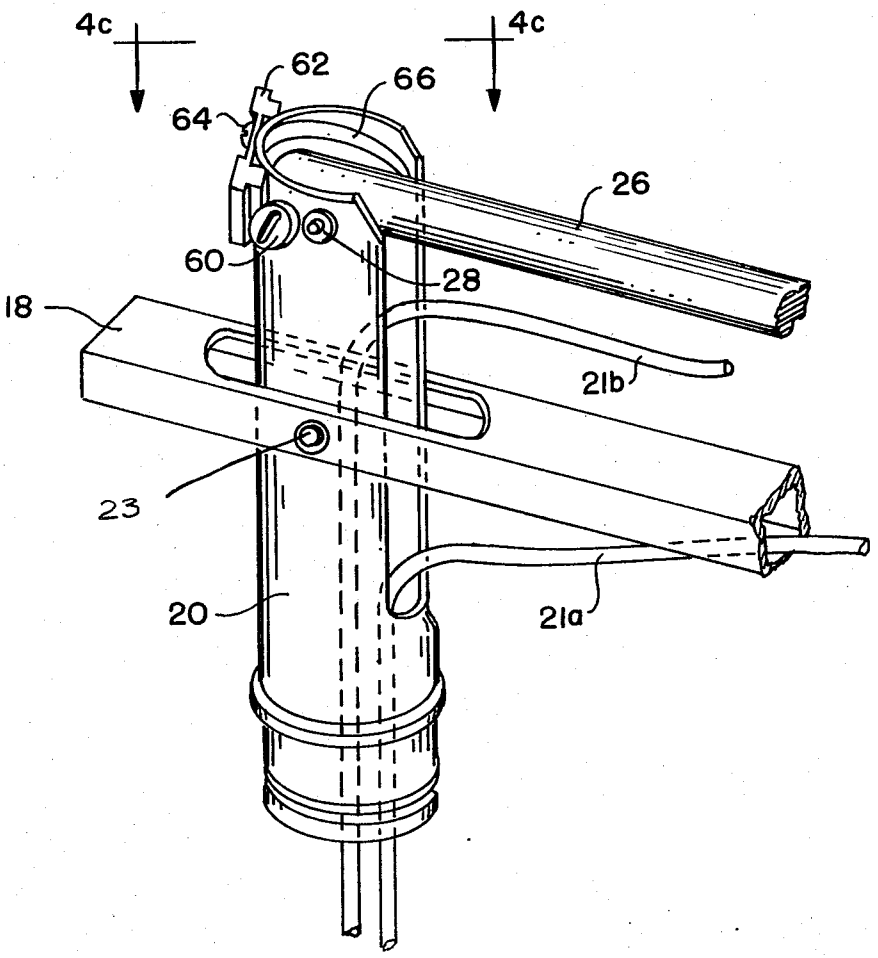
FIG. 4B is a view like of the portion of the assembly shown in FIG. 4A, but taken from the opposite side.

As shown in FIG. 4C, a pair of arcuate-shaped members 66A, 66B act as a bushing eccentrically supporting pin 28 in arm 20. A pair of rack-like members 68A, 68B are respectively formed on the arcuate members 66A, 66B, and the bolt-like member 60 is formed as a pinion 70 engaging racklike members 68A, 68B.

The relationship between pinion 70 and the rack-like members 68A, 68B is such that the arcuate members 66A, 66B are held at any selected angular position by the pinion, and the angular position of the arcuate member is varied only by turning the bolt-like member 60. This may be achieved, for example, by a screwdriver received in the slot in the head of the bolt-like member.

The effect of turning the bolt-like member 60 is to cause the arm 20 to turn about its pivot pin 23 of arm 18, so the arm, modifying the essential parallel relationship of elements 16 and 20.

The invention provides, therefore, a relatively simple and rugged assembly for adjustably supporting a unit in a desired vertical position and enabling the unit to be locked in the desired vertical position.

It will be appreciated that while a particular embodiment of the invention has been shown and described, modifications may be made. It is intended in the claims to cover all modifications which come within the true spirit and scope of the invention.

I claim:

1. An assembly for supporting a unit at selected vertical positions, said assembly comprising: a first post; a second post spaced from said first post; an arm pivotally coupled at one end to said first post and pivotally coupled at its other end to said second post to be angularly movable in a vertical plane about a pivot axis extending radially through said first post; a rod pivotally coupled at one end to said first post and pivotally coupled at its other end to said second post, said rod extending in spaced and parallel relationship with respect to said arm; a coil spring mounted coaxially on said rod to counter-balance the weight of the supported unit when said arm is moved angularly about said first-named pivot axis, said first post having at least one cam surface formed thereon; and a cam follower member engaging one end of said spring and movable on said cam surface as said second arm is moved angularly about said first-named pivot axis to cause compressive forces to be exerted on said spring as said arm is turned up and down, so that said spring may perform a counter-balancing effect.

2. The assembly defined in claim 1, in which said rod has an intermediate threaded surface, and which includes a nut threaded to said intermediate surface to serve as an adjustable stop for the other end of said spring.

3. The assembly defined in claim 1, and which includes a lock sub-assembly mounted on said arm and selectively engaging said rod to hold said arm at a set angular position when the lock is activated, in which said lock sub-assembly includes a first block mounted on said second arm and having an opening therein through which said rod extends and a slot extending from the opening to one side of the block; and means for selectively squeezing the sides of the slot together to cause the rod selectively to be seized by said block.

4. The assembly defined in claim 3, in which said last-named means comprises a second block angularly movable with respect to the first-named block.

5. The assembly defined in claim 4, and which includes means responsive to pressurized fluid for angularly moving said second block with respect to the first block.

6. The assembly defined in claim 1, in which the unit is rotatably coupled to the lower end of said further post to be angularly movable about the longitudinal axis of said further post.

7. The assembly defined in claim 6, which includes a pin extending through said second post for pivotally coupling said rod to said second post; and which includes a subassembly for leveling the supported unit for different angular positions of said arm, said sub-assembly including an arcuateshaped rack member rotatably mounted on said further post and engaging said rack member to set the inclination of said further-post with respect to said second arm.

8. The assembly defined in claim 7, in which said pinion member is manually adjustable.

* * * * *